US005647259A

United States Patent [19]

Biagiotti

[11] Patent Number: 5,647,259

[45] **Date of Patent: *Jul. 15, 1997**

[54] CLAMP FOR HOLDING LOGS DURING THE PRODUCTION OF TOILET PAPER ROLLS OR THE LIKE

[76] Inventor: Guglielmo Biagiotti, Via di Vorno No.105, 55012 Capannori, Lucca, Italy

[ * ] Notice: The portion of the term of this patent subsequent to Nov. 10, 2013, has been disclaimed.

[21] Appl. No.: 193,948

[22] Filed: Feb. 9, 1994

[30] Foreign Application Priority Data

Feb. 15, 1993 [IT] Italy ..... FI93A0024

[51] Int. Cl.[6] ..... B26D 7/02; B26D 3/16

[52] U.S. Cl. ..... 83/458; 83/460; 83/466; 269/132

[58] Field of Search ..... 83/452, 458, 460, 83/461, 465, 466; 269/130, 131, 132

[56] References Cited

U.S. PATENT DOCUMENTS

| | | | |
|---|---|---|---|
| 1,255,393 | 2/1918 | DeWein | 83/458 |
| 2,679,939 | 6/1954 | Yates | 269/130 X |
| 3,285,490 | 11/1966 | Roper | 269/130 X |
| 4,339,116 | 7/1982 | Benz et al. | 269/130 X |
| 5,038,647 | 8/1991 | Biagiotti | 83/458 X |
| 5,357,833 | 10/1994 | Biagiotti | 83/458 |

FOREIGN PATENT DOCUMENTS

| | | | |
|---|---|---|---|
| 526412 | 2/1993 | European Pat. Off. | 83/452 |
| 611637 | 8/1994 | European Pat. Off. | 83/452 |

*Primary Examiner*—Rinaldi I. Rada
*Assistant Examiner*—Clark F. Dexter
*Attorney, Agent, or Firm*—Francis J. Bouda

[57] ABSTRACT

A clamp is shown for holding a log of paper while a log-saw or cutting machine cuts shorter lengths of toilet-paper rolls or rolls of kitchen towels or similar all-purpose wipers from the log. The clamp is arranged adjacent a seat or support for the log as well as adjacent a cutting blade. The clamp includes, for each log seat, and on opposite sides of a cutting plane (T—T) through which the blade passes, a pair of adjustable and symmetrically arcuate strips (212, 214) secured to supports (207, 209). The strips are of flexible material with end portions which tend to spring outwardly. A strap (222) is anchored to a retention holder (224) and an adjustment holder (246). The strap surrounds the pair of strips (212, 214) and can change the arrangement thereof. A drive (240, 262) simultaneously adjusts both the effective length of the strap (222) and the symmetrical angular orientations of two rods (228A, 228B) and, consequently, of two cradles (218) on which the strips are supported.

6 Claims, 4 Drawing Sheets

CLAMP FOR HOLDING LOGS DURING THE PRODUCTION OF TOILET PAPER ROLLS OR THE LIKE

BACKGROUND OF THE INVENTION

The invention refers to an improvement to a device for supporting and restraining a log of paper in a machine for cutting the logs into shorter rolls of toilet paper, kitchen towels (all-purpose wipers) and the like. It is often referred to as a "log saw" and includes a cutting blade which moves through a cutting plane as it cuts the logs. A device of the prior art is disclosed in European Patent Appl. 0526412, which corresponds to U.S. application Ser. No. 07/915,945. This known device, which can be provided for machines processing a single log, or, simultaneously, more than two or, more logs in parallel array, can be quickly adapted to logs of different diameters. It includes, for each log:

a) a clamp on both sides of the cutting plane.

b) a pair of yielding and symmetrically arcuate strips, secured to relevant supports and with movable end portions, said strips tending to expand outwardly.

c) a strap anchored to a retention holder and to an adjustment holder, and surrounding said pair of strips so as to vary their geometry in relation to the diameter of the logs being processed, the strap encircling approximately half of the log to be cut.

d) two oscillating cradles adjacent to the supports, which cradles conform to the configuration of the strips as the geometry of the strips change; and e) an appendix fixed to each oscillating cradle and associated to each strip, to cooperate with adjustment and locking means.

The invention allows an easier and more accurate adjustment than that obtained by the above-mentioned known device.

BRIEF DESCRIPTION OF THE INVENTION

Substantially, the device according to the present invention comprises a single drive (especially of mechanical type) to simultaneously obtain both the adjustment of the length of the strap(s) and the symmetrical angular movement of the two appendixes and, consequently, of the two cradles.

The device includes an angularly movable actuating member and two connecting rods articulated to eccentric pins at diametrically opposite positions of said angularly movable actuating member. The two connecting rods are engaged to the two appendixes of the oscillating cradles to cause symmetrical and simultaneous angular movement of said two appendixes and, consequently, of the two cradles. A drive is also connected to the actuating member to operate the adjustment holder of the strap which surrounds a pair of strips.

Said drive may comprise means for adjusting the timing or the mutual angular position of the actuating member and an angularly movable member carrying the adjustment holder of the strap. In the drive, provision may be made for an endless, flexible, chain-like timing-belt member or the like, to operate said angularly movable member, which has the shape of a rotor. The strap is partly wound around the angularly movable member which carries the adjustment holder. Two length-adjusting members are provided on the flexible member and can be moved in opposite directions for timing adjustment.

In an apparatus including multiple seats for cutting more than one log at a time, with logs arranged side-by-side and simultaneously cut, provision may be made for bars articulated to the connecting rods, each bar being connected to at least two rods which must be operated simultaneously and in the same direction by the actuating member. In this case, two straps, able to act on the two pairs of cooperating strips arranged side-by-side, may be coupled and engaged to the same holder to be simultaneously operated.

DETAILED DESCRIPTION

The invention will be better understood by following the description and the attached drawing, which shows a practical, not limiting example, of the same invention relevant to a machine capable of simultaneously processing two logs or rolls arranged side-by-side.

In the drawing, where like characters indicate like parts:

Figure 1:
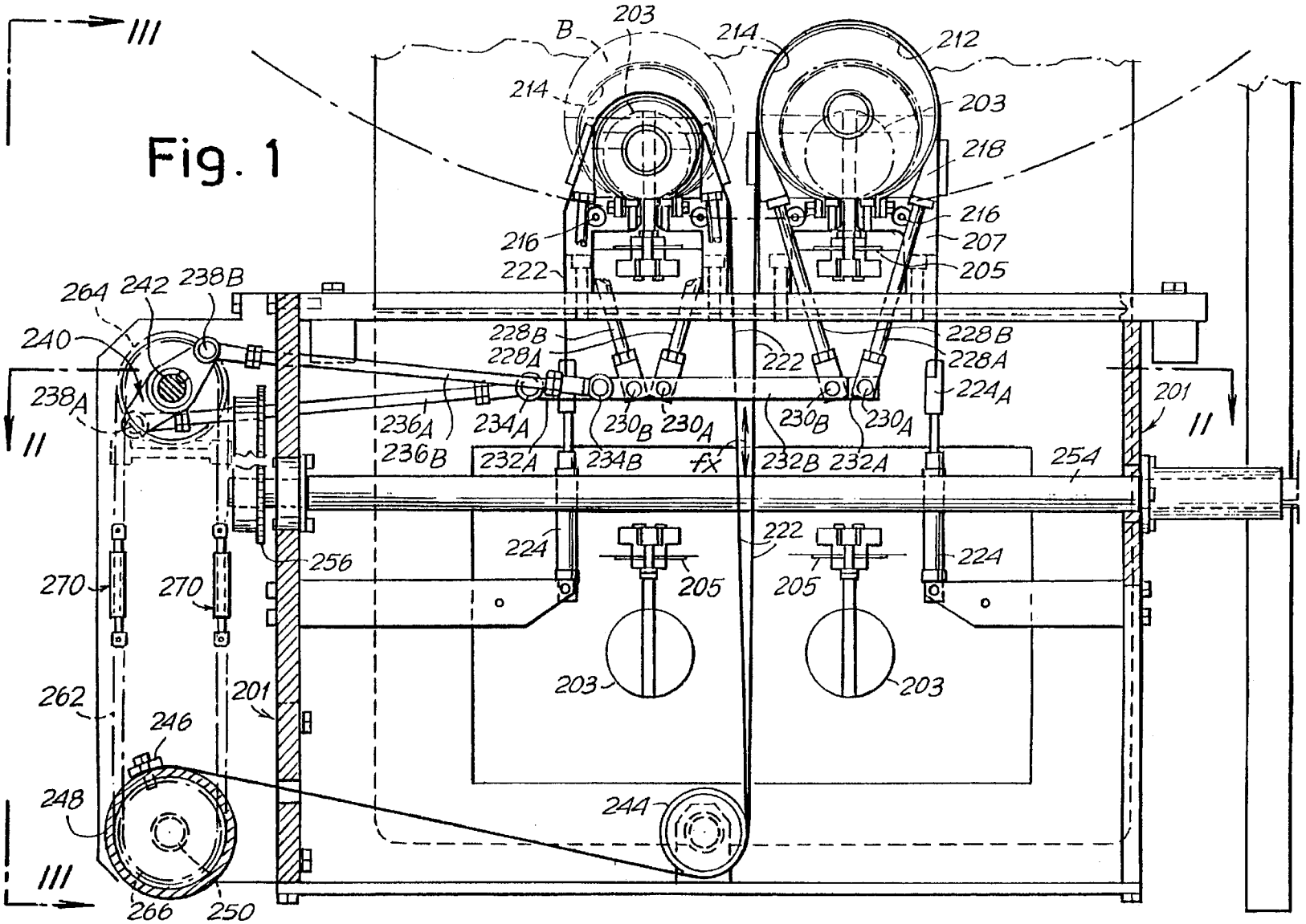
FIG. 1 shows a vertical section taken transversely to the direction of advancement of the rolls or logs, substantially on line I—I of FIG. 2.

In FIG. 1, two clamp devices are shown which are arranged on two parallel log advancing paths. The two devices are shown in two different geometric conditions. The left-hand clamp device is placed in a position suitable for clamping logs of small diameter, while the right-hand clamp device is shown in the position suitable for clamping logs of large diameter. During normal use, the two side-by-side clamp devices work on logs of the same diameter.

Figure 2:
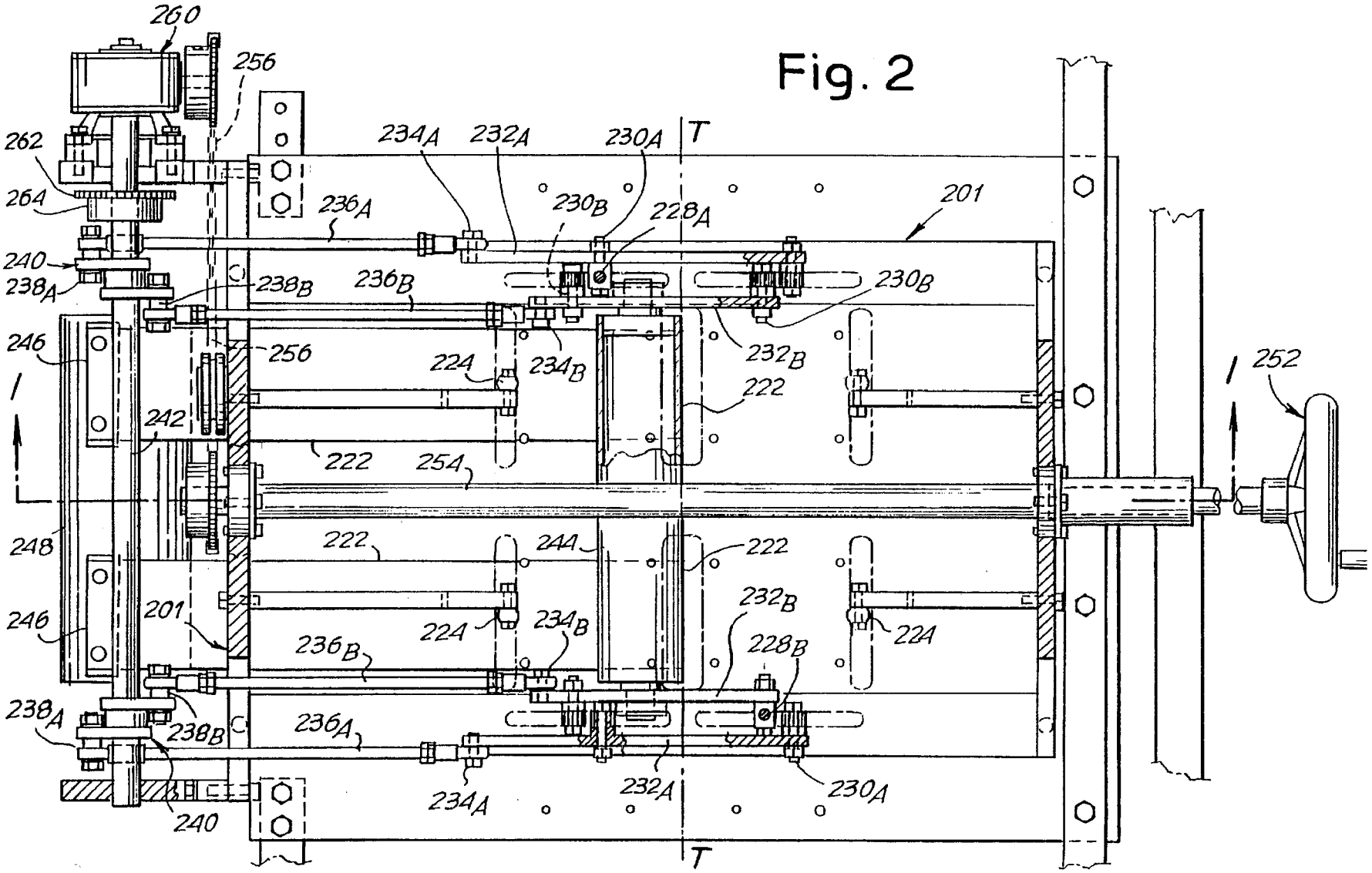
FIG. 2 shows a horizontal section substantially taken on line II—II of FIG. 1.
Figure 3:
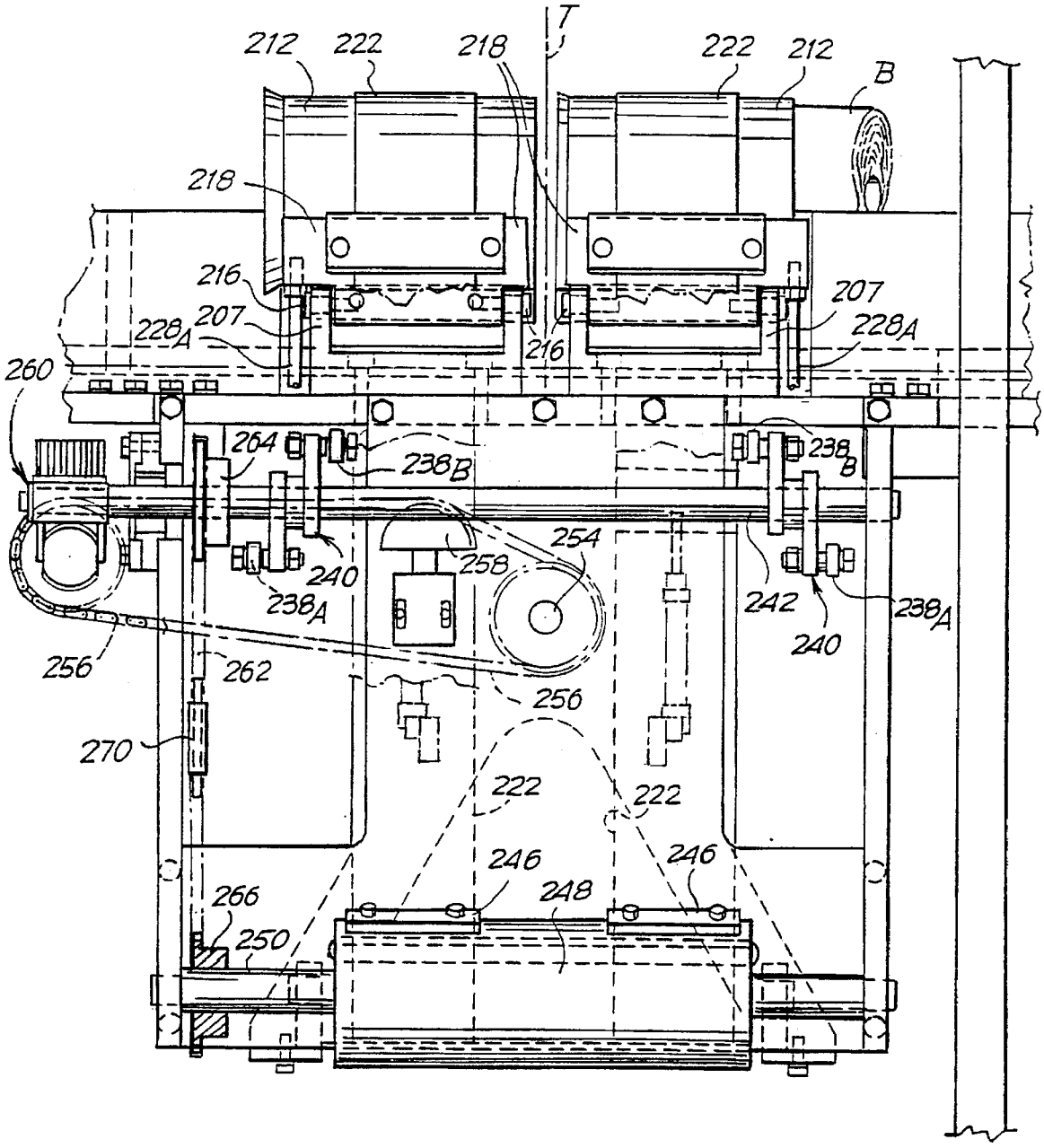
FIG. 3 shows an end view along line III—III of FIG. 1.
Figure 4:
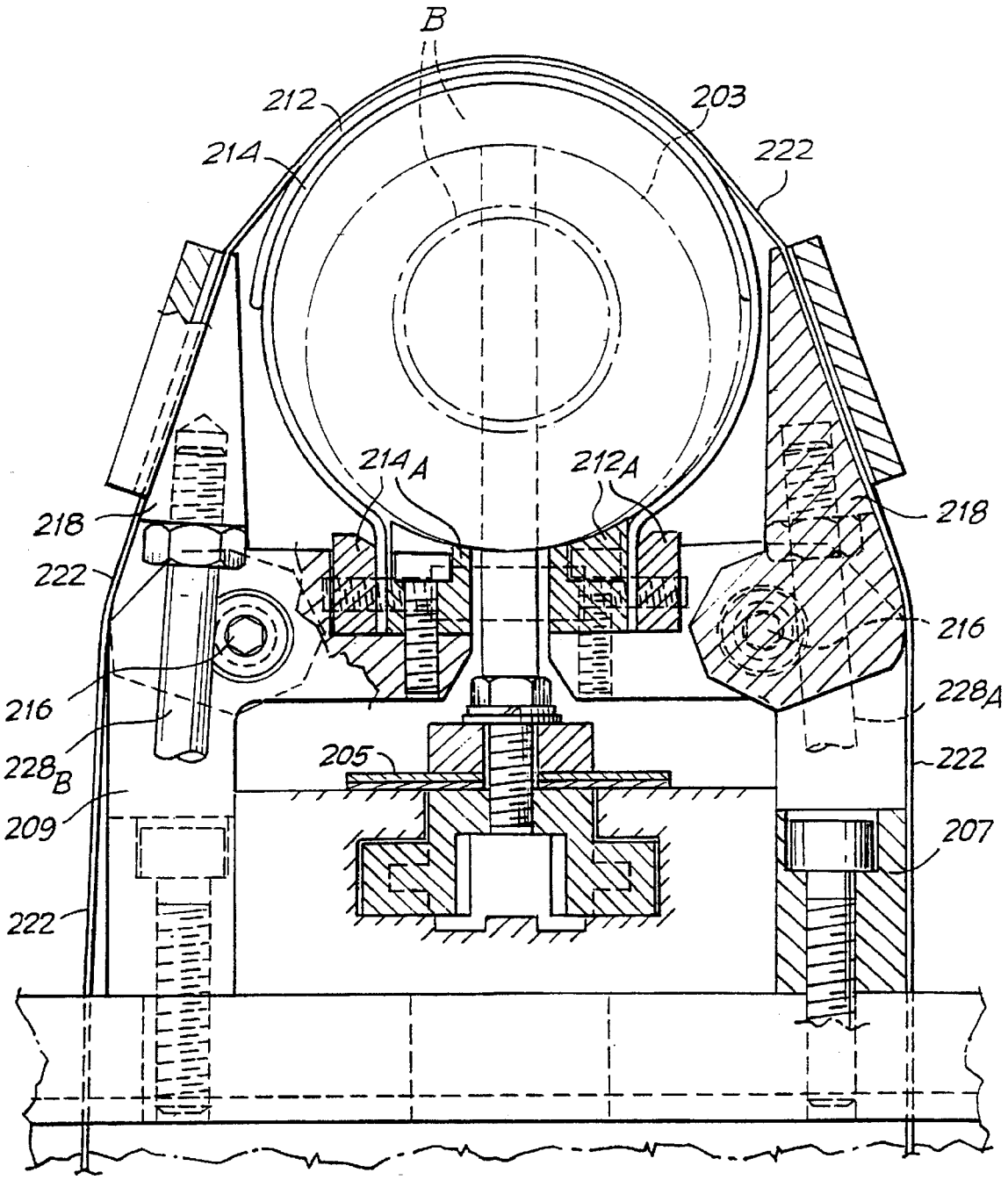
FIG. 4 shows an enlarged detail of one clamp device.

Numeral 201 indicates the supporting frame of the clamping device, and T denotes, in FIGS. 2 and 3, the cutting plane. Numeral 203 in FIG. 1 indicates the pushers which advance the logs. The pushers are carried by an endless flexible member 205 (e.g., a belt or chain). Numerals 207 and 209 indicate external and intermediate supports, respectively. Fixed to supports 207 and 209, by means of clamps 212A and 214A, are flexible strips 212 and 214. The strips 212 and 214 are in a substantially circular hoop-shaped form to create a passage through which a log B may move. The strips 212 and 214 may be made of polycarbonate or other material having low coefficient of friction and tend to spread apart so that logs B may slide within and along said strips. However, the strips can be drawn together to clasp the log and thus can exert a limited pressure on the surface of the logs and support the log against the thrusts which the blade exerts onto the log during cutting, thereby avoiding undesired lateral displacements of said log.

Fastened at pivot-axis 216 to the supports 207 and 209 are symmetrically shaped blocks which form oscillating cradles 218 on which the lower ends of the strips 212 and 214 may rest. The oscillating cradles 218 must be able to assume different angular positions according to the diameter of the logs B to be cut, and to this end they can be pivoted about the respective axis 216.

Surrounding each pair of strips 212, 214 is a respective strap 222. One end of each strap 222 is anchored to a retention holder 224A connected to a pneumatic piston actuator 224 which is capable of extending and thus releasing the strap in order to facilitate the insertion of a roll or log between the strips 212, 214. The opposite ends of the two straps 222 move in the direction of the double arrow fx (FIG. 1) to vary the geometry of (i.e., the size of the opening created by) the strips 212, 214 to accommodate the diameter of the logs to be cut. Any adjustment of the straps 222 according to arrow fx is accompanied by a corresponding and symmetrical angular adjustment of the cradles 218.

A single drive adjusts both the cradles 218 and the straps 222.

Fixed to each oscillating cradle 218 is a rod. FIG. 1 shows rod 228A which is inclined downwards and to the left, and rod 228B which is inclined downwards and to the right. Two pairs of rods 228A and 228B are shown in FIG. 1 for the symmetrical adjustment of the two pairs of cradles 218.

The two rods 228A, lying substantially on the same vertical plane and inclined parallel to each other, are connected at their lower ends 230A to a substantially horizontal bar 232A which is carried by said rods 228A. The bar 232A is engaged, through an articulated joint 234A, to a connecting rod 236A whose crankpin 238A is eccentrically fixed to an actuating member 240 which rotates with a shaft 242. The two rods 228B are connected at their lower ends 230B to a bar 232B (similar to 232A), which is connected by an articulated joint 234B to a connecting rod 236B whose crankpin 238B is also fixed to the actuating member 240 diametrically opposite the crankpin 238A.

An angular and suitably limited displacement of the actuating member 240 causes equal and opposite movements of the two bars 232A and 232B and thereby a corresponding angular displacement of the rods 228A and 228B, respectively. The displacement is symmetrical to vertical planes passing through the axes of the respective cradles (and, therefore, of the logs B supported in the cradles). The angular displacements of the rods 228A and 228B cause the displacements of cradles 218 and places them in a correct angular position to support the strips 212 and 214.

Correspondingly, the two straps 222 must be moved (according to double arrow fx) in order to change the diameter of the circle defined by the two strips 212, 214. To this end, the two straps 222 (lying with their centerline in the same transversal plane) are joined and simultaneously fed around a pulley 244, and connected to a rotor 248 by means of an adjustment holder or adjustable clamp 246. This rotor 248 is supported on a shaft 250 which is parallel to the shaft 242 and arranged beneath the latter. The two shafts 242, 250 must be operated simultaneously and rotated to the same degree so as to simultaneously vary the angle of inclination of rods 228A, 228B, as well as the position of the cradles 218 and the extension of the straps 222.

For the above purpose, a single drive means, which is operated either manually through a handwheel 252 or by servomotor (not shown), rotates a drive shaft 254 horizontally mounted on frame 201. The drive shaft 254 is connected to a chain drive 256 provided with a suitable stretcher 258, to operate a gear reduction box, generally shown at 260, which causes the shaft 242 to rotate. Another chain drive 262 passes around a chain wheel 264 (keyed on shaft 242) and onto a chain wheel 266 (keyed on shaft 250). There is a transmission ratio of 1:1 between the shafts 242 and 250.

The shafts 242 and 250 perform relatively limited rotations and, therefore, the chain 262 driven around chain wheels 264 and 266 also performs limited movements. On the two sections of chain extending between the two wheels 264 and 266, there are provided two length-adjusting members 270 which include suitably-threaded stems engaging into a threaded sleeve. The latter is rotatable relative to the stems in such a way that each of the two length-adjusting members 270 can be operated to change the length of the portions therebetween and, correspondingly, to move the two portions of chain (which are anchored to each of said length-adjusting members) close to or away from each other. By turning these members 270 in opposite directions one of them is lengthened and the other is shortened. This enables the timing between the shafts 242 and 250 to be easily adjusted and the machine registered to achieve corresponding, simultaneous variations in the position of both the cradles 218 and the straps 222 for obtaining a corresponding change of the geometry of the pairs of cooperating strips 212, 214 as may be needed to accommodate logs of different diameters.

As shown in the drawing, to achieve a firm retention of the logs during cutting thereof by a circular blade (not shown) acting in the cutting plane T, two clamps are provided for each log. Each clamp includes a pair of strips 212 and 214, the respective cradles 218 and the respective strap 222. One such clamp is arranged on each side of the cutting plane T. When two parallel logs are cut simultaneously, two pairs of straps 222, which must be operated simultaneously, and two systems for adjusting the inclination of rods 228A and 228B associated to each one of the two clamping units made up of the strips, straps and cradles, are provided.

This is achieved by means of co-axial pulleys 244 or by a single roller located in alignment with the downwardly extending portions of the pairs of straps.

On the shaft 250, a rotor 248 is provided which axially extends to engage the two pairs of straps by means of two relevant clamps 246. Since the straps are extremely thin (steel laminae), the variation in diameter is negligible.

On the shaft 242 are two actuating members 240 carrying crankpins 238A and 238B to operate the connecting rods 236A, 236B and the bars 232A and 232B for the corresponding rods of the two clamping units. The two clamping units are clearly shown in FIG. 3, and the respective drive systems comprising the. connecting rods 236A and 236B are shown in FIG. 2. All these systems are operated simultaneously by a simple action of the drive shaft 254, according to the diameter of the logs being cut. The timing of the two shafts 242, 250, accomplished through the adjustment members 270, makes it possible to set the angular displacement of the rods 228A and 228B and thus the position of the cradles 218 in a desired relationship with respect to the effective length of the straps 222 which are adjustable in the direction of the double arrow fx.

During processing of a single log B, the latter is advanced through the passage defined by the pairs of strips 212 and 214. During subsequent advancement steps of the log the strap 222 is not slackened. The low coefficient of friction of strips 212, 214 permits the sliding of the log even when a slight radial force is exerted thereon. Any slight variation of the log diameter can be accommodated by the pneumatic piston 224. The operator can change the extention of the strap 222 and the position of the cradles 218 (and consequently the position of the strips 212, 214) by means of rotation of shaft 254 only when the cutting machine has to be adapted in order to process logs of a new, different diameter. In that case, an angular displacement of the single shaft 254 performs all the necessary adjustments.

It is understood that the drawing shows an exemplification given only as a practical demonstration of the invention, as this may vary in the forms and dispositions without, nevertheless, coming out from the scope of the idea on which the same invention is based. The presence of reference numbers in the appended claims has the purpose of facilitating the reading of the claims, reference being made to the description and the drawing, and does not limit the scope of the protection represented by the claims.

Having thus described the invention, what is claimed as new and desired to protect by Letters Patent are the following:

1. A log-cutting machine comprising a cutting blade operating in a cutting plane, a clamping device for the retention of a log such that the log extends in a log-advancing path through to the cutting plane, and a control means connected to the clamping device, the clamping device being quickly adaptable to logs of different diameters while the cutting machine is operating, said clamping device including on each side of the cutting plane (T—T):

a pair of clamps (212A, 214A),and a pair of yielding arcuate strips (212, 214) each having a first end fixed to a respective one of said clamps (212A, 214A) and a respective second free end;

a strap (222) anchored at one end to a retention holder (224A) and at the other end to an adjustment holder (246) and surrounding said strips (212, 214) to change the geometry thereof to accommodate the diameter of the log (B) being processed, whereby said strap (222) extends around approximately half the circumference of the log to be cut;

a pair of support means (207, 209) for supporting a respective one of said clamps (212A, 214A), and two opposite oscillating cradles (218), each cradle being located adjacent to a respective one of the clamps (212A, 214A) and being pivotally supported by a respective one of said support means (207, 209); and a pair of rods (228A, 228B), one connected to one of the oscillating cradles (218) and the other connected to the other oscillating cradle 218, characterized in that said control means is connected to the adjustment holder and to the rods to provide simultaneously adjustment of the effective length of the strap and the angular position of the cradles to match the diameter of the log to be processed.

2. The log-cutting machine according to claim 1 characterized in that said control means includes: an angularly movable actuating member (240); two pairs of connecting rod members (236A, 236B) one pair on each side of the cutting plane, wherein the connecting rod members of each pair are connected to eccentric pins (238A, 238B) located at diametrically opposite positions on said angularly movable actuating member (240), said two pair of conn rod members (236A, 236B) being connected, respectively to said two rods (228A, 228B) to achieve symmetrical and simultaneous angular positioning of said two rods (228A, 228B) and, consequently, of the cradles; and a drive means (262, 264, 266) operatively connected the actuating member (240) and to operate the adjustment holder (246) to provide said simultaneous adjustment.

3. The log-cutting machine of claim 2, characterized in that two of said clamping devices are connected to said control means, one of said clamping devices being provided in each of two parallel log-advancing paths for cutting two parallel logs.

4. The log-cutting machine of claim 2, characterized in that two pairs of bars (232A,232B) are provided, one pair of bars on each side of the cutting plane, each bar connecting a respective one of the connecting rod members (236A, 236B) to a respective one of said rods (228A,228B).

5. The log-cutting machine according to claim 2 characterized in that the drive means includes an endless, flexible member (262), wherein the endless, flexible member includes adjusting means (270) for a adjusting portion of the endless, flexible member relative to another portion of the endless, flexible member for adjusting the relative positions of the actuating member (240) and the adjustment holder (246) and thus adjusting the effective length of the strap with respect to the angular position of the cradles.

6. The log-cutting machine of claim 1, characterized in that two of said clamping devices are connected to said control means, one of said clamping devices being provided in each of two parallel log-advancing paths for cutting two parallel logs.

* * * * *

UNITED STATES PATENT AND TRADEMARK OFFICE

CERTIFICATE OF CORRECTION

PATENT NO. : 5,647,259

DATED : July 15, 1997

INVENTOR(S) : Guglielmo Biagiotti

It is certified that error appears in the above-identified patent and that said Letters Patent is hereby corrected as shown below:

Claim 2, column 6, line 6, "two pair of conn" should read -- pair of connecting --.

Claim 2, column 6, line 11, "connected the" should read -- connected to the --.

Claim 2, column 6, line 12, "operate" should be deleted.

Signed and Sealed this

Twenty-ninth Day of September, 1998

*Attest:*

*Attesting Officer*

BRUCE LEHMAN

*Commissioner of Patents and Trademarks*